United States Patent [19]

Yamamoto et al.

[11] Patent Number: 4,498,637

[45] Date of Patent: Feb. 12, 1985

[54] METHOD OF WINDING YARN ON BOBBIN

[75] Inventors: Shigeru Yamamoto; Yuzuru Miyake; Isao Nohara, all of Matsuyama, Japan

[73] Assignee: Teijin Seiki Company, Limited, Osaka, Japan

[21] Appl. No.: 399,808

[22] Filed: Jul. 19, 1982

[30] Foreign Application Priority Data

Jul. 22, 1981 [JP] Japan ..... 56-114887

[51] Int. Cl.[3] ..... B65H 54/32; B65H 54/38

[52] U.S. Cl. ..... 242/18.1; 242/43 R; 242/43.1

[58] Field of Search ..... 242/18.1, 43 R, 43.1

[56] References Cited

U.S. PATENT DOCUMENTS

| | | | |
|---|---|---|---|
| 2,285,439 | 6/1942 | Jones | 242/43 R |
| 2,360,909 | 10/1944 | Swanson et al. | 242/43 R |
| 2,705,598 | 4/1955 | Bauer et al. | 242/43 R |
| 4,296,889 | 10/1981 | Martens | 242/18.1 |
| 4,325,517 | 4/1982 | Schippers et al. | 242/18.1 |

FOREIGN PATENT DOCUMENTS 37-11441 5/1962 Japan .

*Primary Examiner*—Stanley N. Gilreath

[57] ABSTRACT

In a yarn take-up device in which a continuous yarn is to be helically wound on a rotating bobbin and traversed alternately in opposite directions parallel with the axis of rotation of the bobbin, a method of winding the yarn on the bobbin, comprising producing signals to control the traverse velocity of the yarn to periodically vary between predetermined minimum and maximum limits and signals to control the traverse distance of the yarn to periodically and continuously vary between predetermined maximum and minimum limits, the cycles of the periodic variation of the traverse velocity being respectively identical with the cycles of the periodic variation of the traverse distance, the maximum limits of the traverse velocity appearing in synchronism with the minimum limits of the traverse distance and the minimum limits of the traverse velocity appearing in synchronism with the maximum limits of the traverse distance.

35 Claims, 14 Drawing Figures

METHOD OF WINDING YARN ON BOBBIN

FIELD OF THE INVENTION

The present invention relates to a method of winding a continuous yarn on a bobbin in a yarn take-up device and more particularly to a method of controlling the yarn traverse distance and velocity with which the yarn is to be guided to move alternately in opposite directions parallel with the axis of rotation of the bobbin.

SUMMARY OF THE INVENTION

In accordance with the present invention, there is provided in a yarn take-up device in which a continuous yarn is to be helically wound on a rotating bobbin and traversed alternately in opposite directions substantially parallel with the axis of rotation of the bobbin, a method of winding the yarn on the bobbin, comprising producing signals effective to control the traverse velocity, in terms of strokes per minute, of the yarn to periodically and continuously vary between predetermined minimum limits and predetermined maximum limits within a predetermined range and signals effective to control the traverse distance of the yarn to periodically vary between predetermined maximum limits and predetermined minimum limits within a predetermined range, the cycles of the periodic variation of the traverse velocity being respectively identical with the cycles of the periodic variation of the traverse distance, the maximum limits of the traverse velocity appearing substantially in synchronism with the minimum limits of the traverse distance and the minimum limits of the traverse velocity appearing substantially in synchronism with the maximum limits of the traverse distance. Preferably, the traverse distance of the yarn is controlled to periodically vary at a rate which increases progressively as the traverse distance decreases from the maximum limit to the minimum limit thereof during each cycle of the periodic variation of the traverse distance and which decreases progressively as the traverse distance increases from the minimum limit to the maximum limit thereof during each cycle of the periodic variation of the traverse distance.

BRIEF DESCRIPTION OF THE DRAWINGS

The drawbacks of a prior-art method of winding a yarn on a bobbin in a yarn take-up device and the features and advantages of a method according to the present invention will be more clearly understood from the following description taken in conjunction with the accompanying drawings in which.

DESCRIPTION OF THE PRIOR ART

Figure 1:
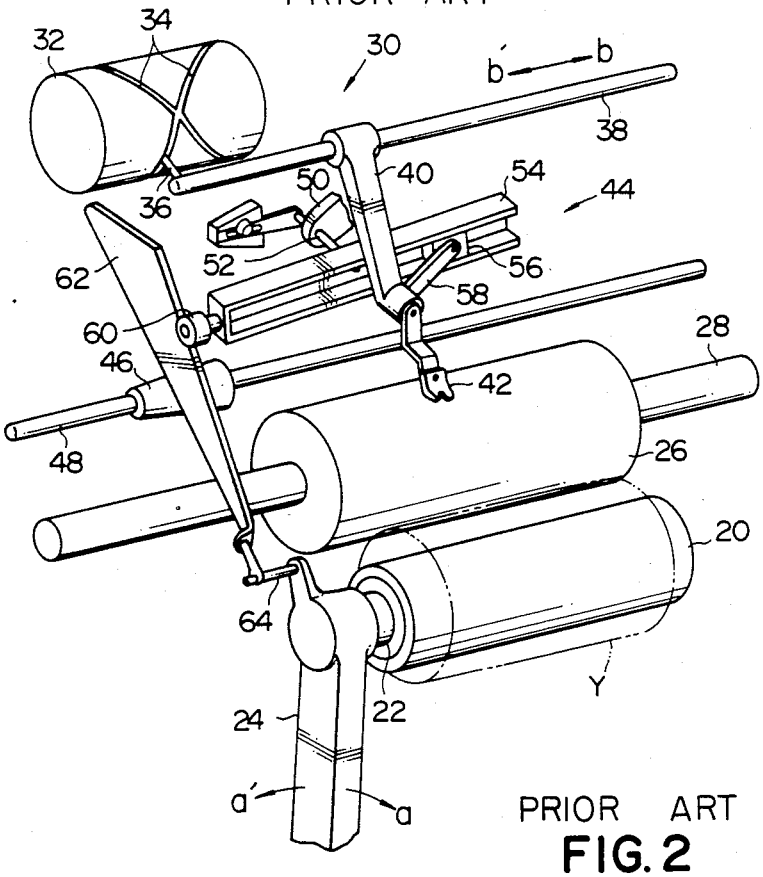
FIG. 1 PRIOR ART
FIG. 1 is a perspective view showing a prior-art yarn take-up device of the type to which the present invention appertains.

Referring to FIG. 1 of the drawings, a known yarn take-up device comprises a cylindrical bobbin 20 rotatable on a spindle 22 extending from a rocking arm 24. The rocking arm 24 is rockable on a plane perpendicular to the center axis of the bobbin 20 as indicated by arrowsheads a and a'. The bobbin 20 is thus angularly movable about the pivot axis of the rocking arm 24 and is adapted to have a continuous yarn helically wound thereon into a suitable form of yarn package Y such as, for example, a cheese, a cone, or a biconical yarn package. In parallel with the bobbin 20 is provided a friction roller 26 which is carried on a drive shaft 28 and which is thus adapted to be driven for rotation about the center axis of the drive shaft 28. During operation of the yarn take-up device, the yarn package Y is held in rolling contact with the friction roller 26 and is driven for rotation about the center axis of the spindle 22. The yarn to be wound on the bobbin 20 is fed through a traversing mechanism 30 adapted to distribute the yarn uniformly throughout the length of the yarn package Y. The traversing mechanism 30 comprises a multiple-turn cylindrical cam 32 which is adapted to be driven for rotation about an axis parallel with the center axis of the bobbin 20 and which is formed with a continuous right-hand and left-hand turning cam groove 34. A cam follower 36 slidably fits in the groove 34 in the cam 32 and is secured to a reciprocating rod 38 extending in parallel with the axis of rotation of the cam 32. The reciprocating rod 38 is axially movable with respect to the cam 32 in opposite directions parallel with the axis of rotation of the cam 32 as indicated by arrowheads b and b'. A bracket arm 40 is secured at one end thereof to the reciprocating rod 38 and has a yarn guide element 42 pivotally carried at the other end thereof. The yarn guide element 42 is adapted to have a yarn slidably retained thereto and is movable with the reciprocating rod 38 and the bracket arm 40 in the neighborhood of the bobbin 20. When the cylindrical cam 32 is driven for rotation about the center axis thereof, the cam follower 36 is caused to move back and forth in parallel with the axis of rotation of the cam 32. The reciprocating motions of the cam follower 36 are transmitted through the reciprocating rod 38 and the bracket arm 40 to the yarn guide element 42 so that the yarn being passed through the guide element 42 is caused to move alternately in opposite directions parallel with the center axis of the bobbin 20 and is uniformly wound on the bobbin 20 over a predetermined length of the bobbin 20. As the diameter of the package Y of the yarn wound on the bobbin 20 increases, the yarn package Y is caused to turn about the pivot axis of the rocking arm 24 as indicated by the arrowhead a. The yarn guide element 42 is pivotally connected to the bracket arm 40 by a pivot pin having a center axis perpendicular in non-intersecting relationship to the reciprocating rod 38. The yarn guide element 42 is thus rotatable with respect to the bracket arm 40 and the reciprocating rod 38 about the center axis of the pivot pin.

The prior-art yarn take-up device further comprises a traverse-distance control mechanism 44 adapted to control the distance which the yarn to be wound on the bobbin 20 is to be guided in dirctions parallel with the center axis of the bobbin 20. The travers-distance control mechanism 44 comprises a frusto-conical cam 46 securely carried on a cam shaft 48 extending in parallel with the reciprocating rod 38, the cam 46 having a center axis offset from the center axis of the shaft 48. The traverse-distance control mechanism 44 further comprises a support arm 50 having a pivot shaft 52 rotatably mounted thereon and extending perpendicularly in non-intersecting relationship to the cam shaft 48. The pivot shaft 52 in turn has fixedly carried thereon an elongated guide member 54 which is thus rotatable about the center axis of the pivot shaft 52. The guide member 54 is formed with a groove and has a slide member 56 slidably received therein. The slide member 56 is coupled to the bracket arm 40 by a link member 58 which is pivotally connected at one end thereof to the slide member 56 and at the other end thereof to the pivot pin retained in the bracket arm 40. The link member 58 is thus rotatable with the yarn guide element 42 about the center axis of the pivot pin. As the bracket arm 40 is moved back and forth with the cylindrical cam 32 driven for rotation about the axis of rotation thereof, the slide member 56 is caused to move back and forth in the groove in the guide member 54 and causes the link member 58 and accordingly the yarn guide element 42 to turn with respect to the bracket arm 40 when the bracket arm 40 is moving toward and away from the limits of the reciprocating movement thereof. The guide member 54 has further mounted thereon a cam follower 60 which is rotatable about an axis approximately parallel with the cam shaft 48. Between the cam 46 and the cam follower 60 is provided a triangular cam plate 62 which has one edge portion held in slidable engagement with the cam 46 and another edge portion held in slidable engagement with the cam follower 60. The cam plate 62 is pivotally connected to the rocking arm 24 by a connecting pin 64 projecting from the rocking arm 24 and connected at its leading end to the cam plate 62.

Figure 2:
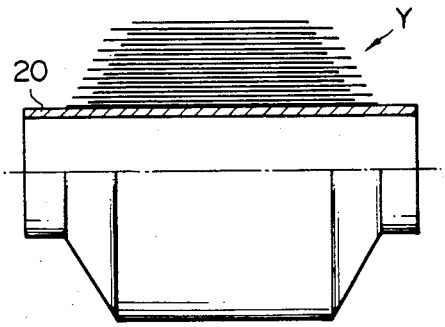
PRIOR ART FIG. 2
FIG. 2 is a view showing, in part in longitudinal section and in part side elevation, a biconical yarn package produced in the prior-art yarn take-up device shown in FIG. 1.

As the diameter of the yarn package Y on the bobbin 20 increases and as a consequence the rocking arm 24 turns in the direction of the arrowhead a, the cam plate 62 is caused to slide on the cam 46 and the cam follower 60 and causes the guide member 54 to turn with respect to the support arm 50 about the pivot shaft 52. As the bracket arm 40 is moved toward one limit of the reciprocating movement thereof, the slide member 56 is caused to move in the groove in the guide member 54 and causes the yarn guide element 42 to turn toward the other limit of the reciprocating movement of the arm 40. The distance which the yarn guide element 42 is caused to reciprocate with respect to the bobbin 20 is thus shorter than the distance of stroke of the bracket arm 40 and is dictated by the angular position of the guide member 54 about the center axis of the pivot shaft 52, Thus, the angular displacement of the slide member 54 about the pivot shaft 52 results in reduction of the distance which the yarn guide element 42 on the bracket arm 40 is permitted to move back and forth in parallel with the axis of rotation of the bobbin 20. As the rocking arm 24 is further turned in the direction of the arrowhead a, the lengths of the layers of the yarn wound on the bobbin 20 are gradually reduced, thereby forming a biconical yarn package Y as shown in FIG. 2 of the drawings. In this instance, the shape of the yarn package Y thus obtained depends upon the shape of the cam plate 62 so that the yarn may be wound on the bobbin 20 into the form of a cone or a cheese if the cam plate 62 is shaped appropriately.

In the prior-art yarn take-up device thus constructed and arranged, a problem is encountered in that the yarn package Y tends to have excess turns of the yarn at the opposite axial ends of each of the layers thereof since the velocities at which the yarn guide element 42 is moved back and forth diminish abruptly at the axial ends of the layers. This results in an increase in the outside diameter of the yarn package Y at the axial ends of the package Y and makes it extremely difficult to have the yarn unwound from the yarn package Y at a high speed. To solve this problem, it has been proposed and put into practice to provide means adapted to drive the cam shaft 48 for rotation about the center axis thereof so as to cause the guide member 54 to periodically rock through a small angle about the center axis of the pivot shaft 52. The distance which the yarn guide element 42 is moved back and forth along the bobbin 20 is thus caused to periodically change while being gradually reduced as the diameter of the yarn package Y increases.

The prior-art yarn take-up device of the described nature another problem is encountered in that the yarn tends to be wound in registry on a turn of the yarn previously wound on the bobbin 20. This occurs by reason of the reciprocating movement of the yarn guide element 42 and makes the outer peripheral surface of the yarn package Y uneven. In order to avoid an occurrence of such a phenomenon (called "ribboning"), it has been proposed to have the cylindrical cam 32 driven for rotation at a periodically varying velocity so that the yarn guide element 42 is caused to reciprocate also at a periodically varying velocity. In a known example of the prior-art yarn take-up device having such a function, the cylindrical cam 32 is driven for rotation at a sinusoidally varying velocity so that the yarn guide element 42 is moved back and forth at a velocity which varies within a predetermined range of between plus and minus 1 to 20 percent across the normal or average velocity of movement of the yarn guide element 42.

The respective techniques to solve the two problems as above discussed have been developed independently of each other and, for this reason, the cycles and timings of the periodic variation in the traverse distance of the yarn are not related to those of the periodic variation in the traverse velocity of the yarn. In the meantime, the relationship between the traverse distance of the yarn and the tension produced in the yarn is such that the tension becomes minimal and maximal when the traverse distance is minimal and maximal, respectively. The relationship between the traverse velocity of the yarn guide element 42 and the tension in the yarn being wound on the bobbin 20 is also such that the tension becomes maximal and minimal when the traverse velocity is maximal and minimal, respectively. Because, however, of the fact that the cycles and the timings of the periodic variation in the traverse distance of the yarn are not related to those of the periodic variation in the traverse velocity of the yarn as above mentioned, the tension in the yarn may become excessive at a certain point of time as when both the traverse distance and the traverse velocity of the yarn are concurrently maximal or the tension in the yarn may become deficient at another point of time as when both the traverse distance and the traverse velocity of the yarn are concurrently minimal. Thus, the tension produced in the yarn being wound on the bobbin 20 is subject to fluctuation over a broad range.

If a yarn is to be unwound at a high speed from a yarn package, it is of basic importance that the yarn package be formed tightly with the yarn wound with a high tension. In this instance, the higher the tension in the yarn, the more prominent is the fluctuation in the tension. For this reason, the traverse velocity and distance of the yarn can not be varied over adequate ranges and, as a consequence, the two problems encountered in the prior-art yarn take-up device as discussed above can not be overcome satisfactorily. Not only difficulties have therefore been experienced in unwinding a yarn from a yarn package at a high speed but it has been impossible to avoid production of dyeing specks in a textile fabric produced by the yarn subjected to fluctuation in tension. The present invention contemplates overcoming such drawbacks and aims at provision of drastic solutions to the problems hereinbefore noted.

DESCRIPTION OF THE PREFERRED EMBODIMENTS

Figure 3:
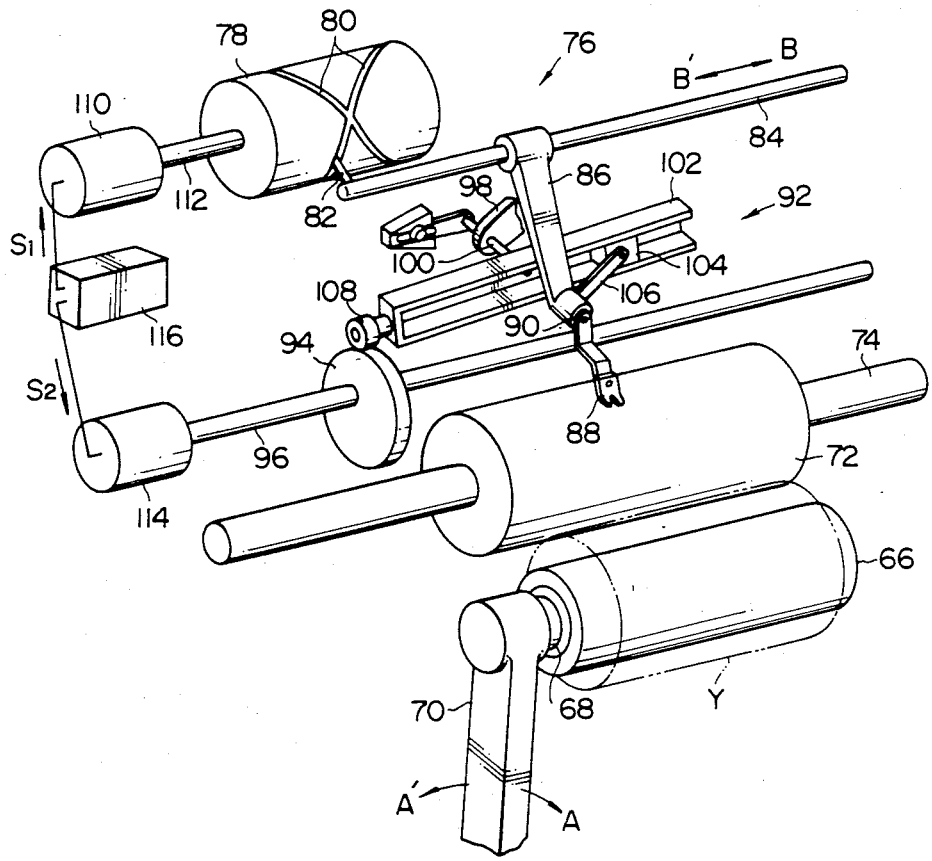
FIG. 3 is a view similar to FIG. 1 but shows a representative example of a yarn take-up device to carry out a method according to the present invention.

Referring to FIG. 3 of the drawings, a yarn take-up device to carry out a method according to the present invention comprises a cylindrical bobbin 66 rotatable about the axis of rotation thereof on a spindle 68 axially extending from a rocking arm 70. The rocking arm 70 is pivotally connected at one end thereof to a suitable support member (not shown) and is rockable on a plane perpendicular to the center axis of the bobbin 66 as indicated by arrowheads A and A'. The bobbin 66 is thus angularly movable about the pivot axis of the rocking arm 70 and is adapted to have a continuous yarn helically wound thereon into a suitable form of yarn package Y such as, for example, a cheese, a cone, or a biconical yarn package. In parallel with the bobbin 66 is provided a cylindrical friction roller 72 which is coaxially carried on a drive shaft 74 connected to suitable drive means (not shown) and which is thus adapted to be driven for rotation about the center axis of the drive shaft 74. During operation of the yarn take-up device, the yarn package Y is held in rolling contact with the friction roller 72 and is driven for rotation about the center axis of the spindle 68. The yarn to be wound on the bobbin 66 is fed through a traverse mechanism 76 adapted to distribute the yarn uniformly throughout the length of the yarn package Y. The traverse mechanism 76 comprises a multiple-turn cylindrical cam 78 which is adapted to be driven for rotation about an axis parallel with the center axis of the bobbin 66 by suitable drive means to be described later and which is formed with a continuous right-hand and left-hand turning cam groove 80. A cam follower 82 slidably fits in the groove 80 in the cam 78 and is secured to a reciprocating rod 84 axially extending in parallel with the axis of rotation of the cam 78. The reciprocating rod 84 is slidably supported on suitable support means (not shown) in such a manner as to be axially movable with respect to the cam 78 in opposite directions parallel with the about the axis of rotation of the cam 78 as indicated by arrowheads B and B'. A bracket arm 86 is secured at one end thereof to the reciprocating rod 84 and has a yarn guide element 88 pivotally carried at the other end thereof. The yarn guide element 88 is in the form of a prong adapted to have a yarn slidably retained thereto and is movable with the reciprocating rod 84 and the bracket arm 86 in the neighborhood of the bobbin 66. When the cylindrical cam 78 is driven for rotation about the center axis thereof, the cam follower 82 engaging the cam 78 through the groove 80 therein is caused to move back and forth in parallel with the axis of rotation of the cam 78. The reciprocating motions of the cam follower 82 are transmitted through the reciprocating rod 84 and the bracket arm 86 to the yarn guide element 88 so that the yarn being passed through the yarn guide element 88 is caused to move alternately in opposite directions parallel with the axis of rotation of the bobbin 66 and is thereby uniformly wound on the bobbin 66 over a predetermined length of the bobbin 66. The length of the yarn package Y formed on the bobbin 66 is thus dictated by the distance between the axial limits of the continuous cam groove 80 in the cam 78. As the diameter of the package Y of the yarn which is continuously wound in layers on the bobbin 66 increases, the yarn package Y constantly contacted by the friction roller 72 is caused to turn about the pivot axis of the rocking arm 70 as indicated by the arrowhead A. As in the prior-art yarn take-up device shown in FIG. 1, the yarn guide element 88 is pivotally connected to the bracket arm 86 by a pivot pin 90 having a center axis perpendicular in non-intersecting relationship to the reciprocating rod 84. The yarn guide element 88 is thus rotatable with respect to the bracket arm 86 and the reciprocating rod 84 about the pivot pin 90.

The yarn take-up device to carry out a method according to the present invention further comprises a traverse-distance control mechanism 92 adapted to control the distance Dt which the yarn to be wound on the bobbin 66 is to be guided or traversed in directions parallel with the center axis of the bobbin 66. The traverse-distance control mechanism 92 comprises a disc-shaped cam 94 having a circular cross section and securely carried on a cam shaft 96 extending in parallel with the reciprocating rod 84, the cam 94 having a center axis offset from the center axis of the shaft 96. The cam shaft 96 is supported on a suitable stationary support structure (not shown) and is rotatable with respect to the support structure about the center axis thereof. The traverse-distance control mechanism 92 further comprises a support arm 98 secured to a suitable stationary structure (not shown) and having a pivot shaft 100 rotatably mounted thereon and axially extending perpendicularly in non-intersecting relationship to the center axis of the reciprocating rod 84. The pivot shaft 100 in turn has fixedly carried thereon an elongated guide member 102 which is thus rotatable about the center axis of the pivot shaft 100 with respect to the support arm 98. The guide member 102 is formed with a groove extending ar right angles to the pivot shaft 100 and has a slide member 104 slidably received therein. The slide member 104 is coupled to the above mentioned bracket arm 86 by a link member 106 which is pivotally connected at one end thereof to the slide member 104 and at the other end thereof to pivot pin 90 retained in the bracket arm 86. The link member 106 is thus rotatable with the yarn guide element 88 with respect to the bracket arm 86 about the center axis of the pivot pin 90. As the bracket arm 86 is moved back and forth with the cylindrical cam 78 driven for rotation about the center axis thereof, the slide member 104 is caused to move back and forth in the groove in the guide member 102 and causes the link member 106 and accordingly the yarn guide element 88 to turn with respect to the bracket arm 86 when the bracket arm 86 is moving toward and away from the limits of the reciprocating movement thereof. As the bracket arm 86 is moved toward one of the limits of the reciprocating movement thereof, the yarn guide element 88 is thus caused to turn about the center axis of the pivot pin 90 on the bracket arm 86 toward the other limit of the reciprocating movement of the arm 86. The distance which the yarn guide element 88 is caused to reciprocate with respect to the bobbin 66 is thus made shorter than the distance of stroke of the bracket arm 86 and is dictated by the angular position of the guide member 102 about the center axis of the pivot shaft 100. Thus, the angular displacement of the slide member 102 about the center axis of the pivot shaft 100 results in reduction of the distance Dt which the yarn guide element 88 on the bracket arm 86 is permitted to move back and forth in parallel with the center axis of the bobbin 66. Rotation of the disc-shaped cam 94 on the cam shaft 96 causes the guide member 102 to turn about the center axis of the pivot shaft 100. As the guide member 102 is thus caused to turn about the pivot shaft 100, the traverse distance decreases gradually so that the yarn is wound into biconical form as shown in FIG. 2. The cam shaft 96 is driven to turn alternately in opposite directions through a predetermined angle or predetermined angles about the center axis thereof, with the result that the traverse distance varies periodically as will be described in more details with reference to FIG. 4 of the drawings. As the diameter of the yarn package Y of the yarn thus wound on the bobbin 66 increases gradually, the rocking arm 70 is caused to turn away from the spindle 74. The guide member 102 has further mounted thereon a cylindrical cam follower 108 rotatable with respect to the guide member 102 about an axis which is approximately parallel with the cam shaft 96. The cam follower 108 is held in rollable contact with the disc-shaped cam 94 on the cam shaft 96.

The yarn take-up device to carry out a method according to the present invention further comprises first drive means to drive the cylindrical cam 78 for rotation about the center axis thereof and second drive means to drive the cam shaft 96 for rotation about the center axis thereof. The first drive means is assumed to comprise an electric motor 110 of the variable-speed type, and a drive shaft coupled to the output shaft of the motor 110 and having the cam 78 securely and coaxially supported thereon. Likewise, the second drive means is assumed to comprise an electric motor 114 of the variable-speed type having its output shaft coupled to the cam shaft 96. The motor 114 thus constituting the second drive means is of the type in which not only the output speed thereof but also the angle of rotation thereof are adjustable. The output speed of the motor 110 and the output speed and the angle of rotation of the motor 114 are adjusted by suitable control means 116 electrically connected to the motors 110 and 114 and operative to supply control signals $S_1$ and $S_2$ to the motors 110 and 114, respectively.

Figure 4:
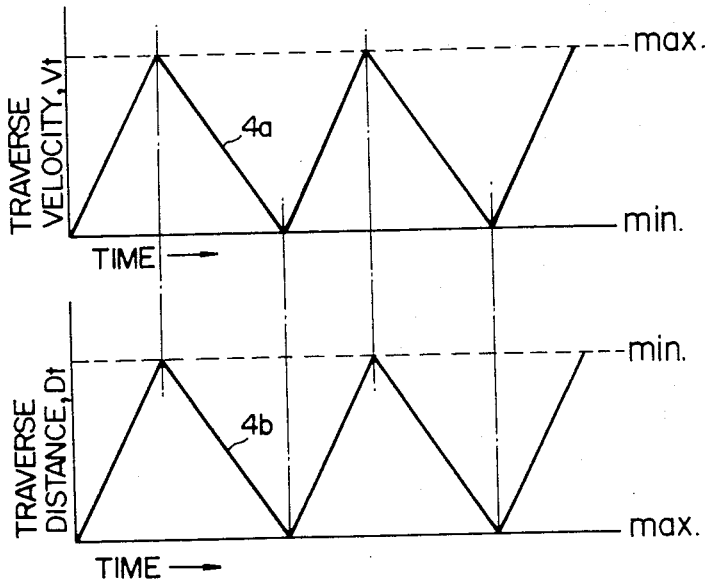
FIG. 4 is a view showing plots indicating the principles on which the traverse velocity and the traverse distance of the yarn to be wound on a bobbin are to be controlled in accordance with one important aspect of the present invention.

When, now, the motor 110 having its output shaft 112 coupled to the cylindrical cam 78 is in operation, the cam 78 is driven for rotation about the center axis thereof so that the cam follower 82 fitting in the groove 80 in the cam 78 is caused to move back and forth in directions parallel with the centr axis of the cam 78. Such movements of the cam follower 82 is followed by reciprocating movements of the reciprocating rod 84, bracket arm 86 and yarn guide element 88 so that the yarn passed through the yarn guide element 88 is helically wound in layers on the bobbin 66. Under these conditions, the control means 116 delivers to the motor 110 a control signal $S_1$ effective to periodically vary the output speed of the motor 110 within a predetermined range. In this instance, the tension produced in the yarn being wound on the bobbin 66 becomes maximal and minimal when the traverse velocity Vt of the yarn is maximal and minimal, respectively. The plot **4*a* in FIG. 4 shows the periodic variation in the traverse velocity Vt, in terms of strokes per minute of the yarn which is thus driven to move back and forth along the bobbin 66. On the other hand, the motor 114 is supplied from the control means 116 with a signal $S_2$ effective to cause the cam 94 and the cam shaft 96 to turn through a predetermined angle alternately in opposite directions about the center axis of the cam shaft 96. Such turning motions of the cam shaft 96 and the cam 94 eccentrically carried on the cam shaft 96 are followed by rocking motions of the guide member 102 about the center axis of the pivot shaft 100 through the rolling engagement between the cams 94 and the cam follower 108. In this instance, the tension produced in the yarn being wound on the bobbin 66 becomes maximal and minimal when the traverse distance Dt of the yarn is maximal and minimal, respectively. The plot 4*b* in FIG. 4 shows the periodic variation in the traverse distance Dt of the yarn. The signals $S_1$ and $S_2$ thus supplied from the control means 116 to the motors 110 and 114, respectively, are such that the cycles of the periodic variation in the traverse velocity Vt of the yarn are respectively identical with the cycles of the periodic variation in the traverse distance Dt of the yarn. The signals $S_1$ and $S_2$ are further such that the traverse distance Dt of the yarn becomes maximal when the traverse velocity Vt becomes minimal and that the traverse distance Dt of the yarn becomes minimal when the traverse velocity Vt becomes maximal. In this intance, the periods of time for which the traverse velocity Vt is on the increase and decrease, respectively, during each cycle of variation thereof are respectively equal to the periods of time for which the traverse distance Dt is on the decrease and increase, respectively, during each cycle of variation thereof as will be seen from the plots 4***a* and 4*b* in FIG. 4 but the ratio between the periods of time for which each of the traverse distance Dt and the traverse velocity Vt is increase and decrease or on the decrease or increase need not be limited to 1:1 but may be varied arbitrarily. In FIG. 4*b* (and also in each of the similar figures to follow), the axis of abscissa corresponds to one of the opposite ends or limits of traversing movement involving no periodic variation in the traverse distance and may thus represent a traverse distance which is maintained constant for the formation of a cylindrical yarn package or which is reduced gradually for the formation of a biconical yarn package.

The yarn guide element 88 being driven to move in these manners, the tension produced in the yarn being wound on the bobbin 66 is rendered practically constant and the yarn package Y is formed to a uniform degree of tightness. The traverse distance Dt and velocity Vt of the yarn can thus be periodically varied within broader ranges than where the cycles of variation of the traverse distance are not synchronized with the cycles of variation of the traverse velocity.

Figure 5:
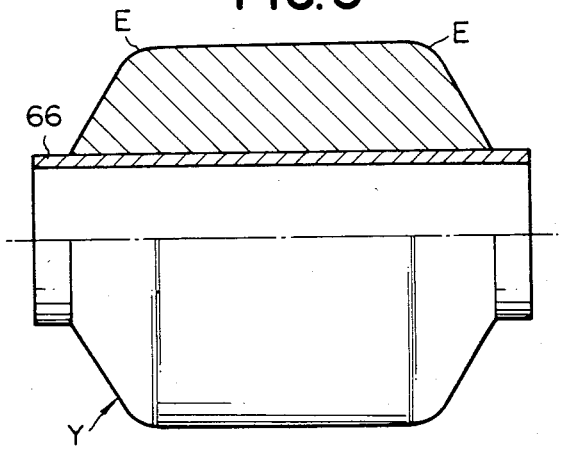
FIG. 5 is a view showing, partly in longitudinal section and partly in side elevation, an example of a defective yarn package which would be produced when a yarn is wound with the traverse distance controlled to vary as indicated in FIG. 4.
Figure 6:
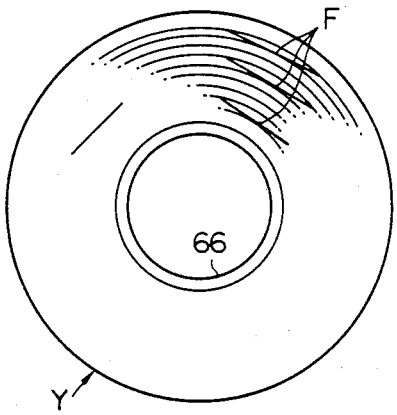
FIG. 6 is an end view showing another example of a defective yarn package which would be produced when a yarn is wound with the traverse distance controlled to vary as indicated in FIG. 4.
Figure 7:
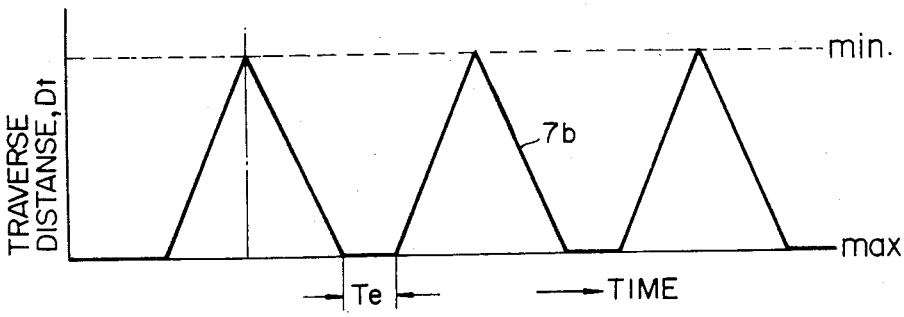
PRIOR ART FIG. 7
FIG. 7 is a view showing a plot indicating a principle on which the yarn traverse distance may be controlled to obviate the defects indicated in FIGS. 5 and 6.
Figure 8:
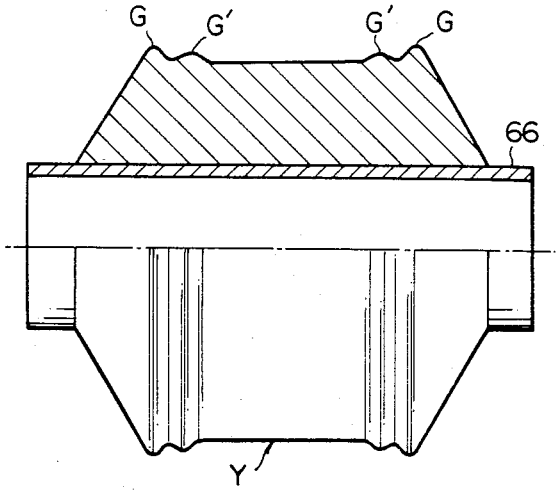
PRIOR ART FIG. 8
FIG. 8 is a view showing, partly in longitudinal section and partly in side elevation, a yarn package produced when the yarn traverse distance is controlled on the principle indicated by the plot shown in FIG. 7.

For the purpose that the tension in the yarn being wound on the bobbin 66 be maintained constant, it is preferable that the mode of periodical variation in the traverse distance Dt be identical to the mode of periodical variation in the traverse velocity Vt of the yarn as shown in FIG. 4. If, however, the traverse distance Dt of the yarn is varied linearly, viz., at a fixed rate as indicated by the plot 4*b* in FIG. 4, the layers of the yarn forming the resultant yarn package Y may have rounded circumferential edges as indicated at E in FIG. 5 and may cause the yarn fail to form a layer at an end face of the yarn package Y as indicated at F in FIG. 6. Such defects could be obviated if the traverse distance Dt of the yarn is maintained constant at the maximum limit thereof for a predetermined period of time Te during each cycle of the periodic variation as shown in FIG. 7 of the drawings. A yarn package Y formed in this manner however tends to have two circumferential rib portions at each end of the outer peripheral surface thereof as indicated at G and G' in FIG. 8. These rib portions G and G' are formed in correspondence with the maximum and minimum limits, respectively, of the traverse distance Dt. Formation of such rib portions G and G' on the yarn package Y may cause breaks of the yarn when the yarn is to be unwound at a high speed from the yarn package Y. This is because of the fact that, when the yarn is being unwound from the rib G or G' opposite to the direction in which the yarn is being unwound, the yarn being unwound rolls on the yarn in the underlying layer and causes the latter to become loose and catch the yarn being unwound. The larger the diameters of yarn packages and the greater the extents to which ribboning is produced in the yarn packages, the more frequently will the breaks of the yarn thus caused occur.

Figure 9:
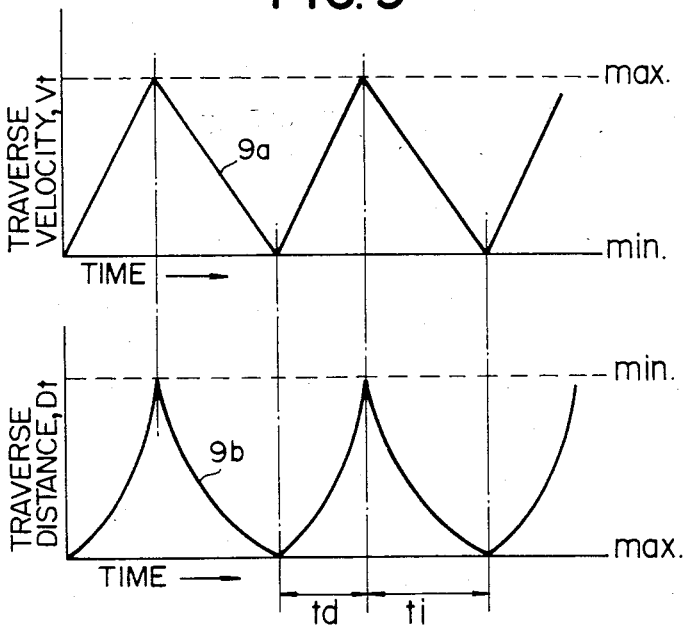
FIG. 9 is a view showing plots indicating the principles on which the traverse velocity and the traverse distance of the yarn to be wound on a bobbin are to be controlled in accordance with another important aspect of the present invention.

To preclude formation of rib portions on a yarn package produced as described above, the signal $S_2$ delivered from the control means 116 to the motor 114 (FIG. 3) is, preferably, further such that the resultant traverse distance Dt of the yarn varies at a rate which increases progressively as the traverse distance Dt varies from the maximum light to the minimum limit thereof during each cycle of the periodic variation of the traverse distance Dt, as indicated by the plot 9*b* in FIG. 9 of the drawings. Thus, the traverse distance Dt of the yarn decreases from the maximum limit to the minimum limit thereof at a rate increasing with time and increases from the minimum limit to the maximum limit thereof at a rate which decreases with time during each cycle of the periodic variation of the traverse distance Dt. Thus, the curve showing the variation of the traverse distance Dt in FIG. 9 becomes part of a downwardly convex parabola or quasi-parabola when the traverse distance is varied from the maximum limit to the minimum limit and part of a downwardly convex parabola or quasi-parabola when the traverse distance is thereafter varied from the minimum light to the maximum limit. When the traverse distance Dt of the yarn is controlled in this fashion, formation of rib portions on a yarn package can be alleviated significantly as indicated at H in FIG. 10 of the drawings. Controlling the traverse distance Dt of the yarn in the above described manner is further conducive to preventing an occurrence of ribboning of the yarn since the traverse distance Dt of the yarn is at all times varying. In accordance with the present invention, an occurrence of ribboning can thus be precluded not only by the periodic variation of the traverse velocity Vt of the yarn but also by controlling the traverse distance Dt of the yarn. Because, furthermore, of the fact that the tension in the yarn being wound on the bobbin 66 in a method according to the present invention is maintained practically constant as previously noted, the traverse distance Dt and traverse velocity Vt can be periodically varied over broader ranges than in a prior-art yarn take-up device and, for this reason, the yarn package obtained in accordance with the present invention is almost free from ribboning of the yarn and is adapted for unwinding of the yarn at a high speed. In controlling the traverse distance Dt of the yarn in the above described manner, the ratio between the periods of time Td and Ti for which the traverse distance Dt is on the decrease and increase, respectively, need not be limited to 1:1 but may be varied arbitrarily as previously noted with reference to FIG. 4.

Figure 10:
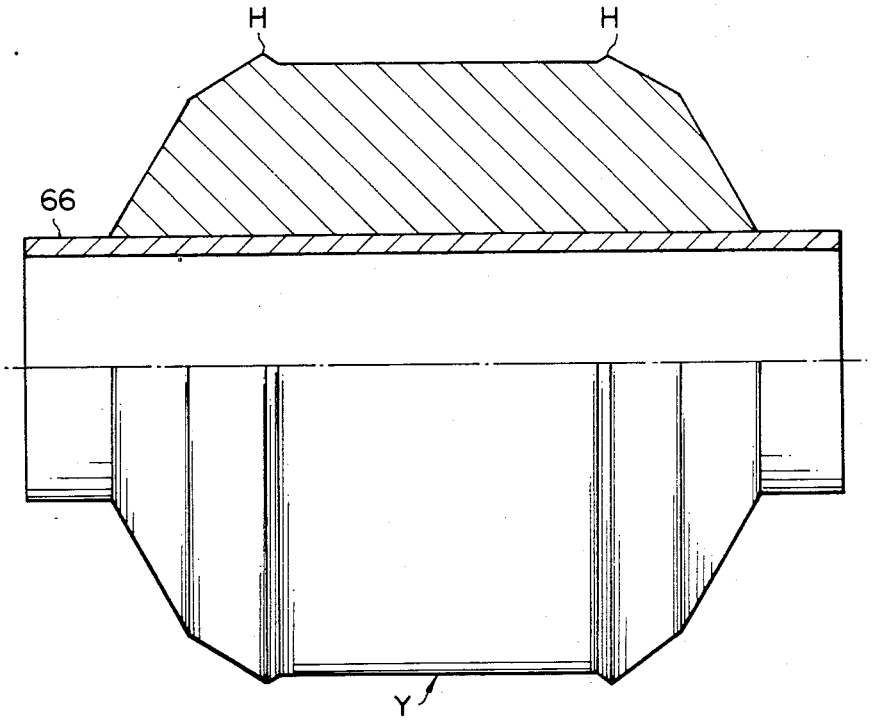
FIG. 10 is a view showing, partly in longitudinal section and partly in side elevation, a yarn package produced when the yarn traverse distance is controlled on the principles indicated by the plots shown in FIG. 9.
Figure 11:
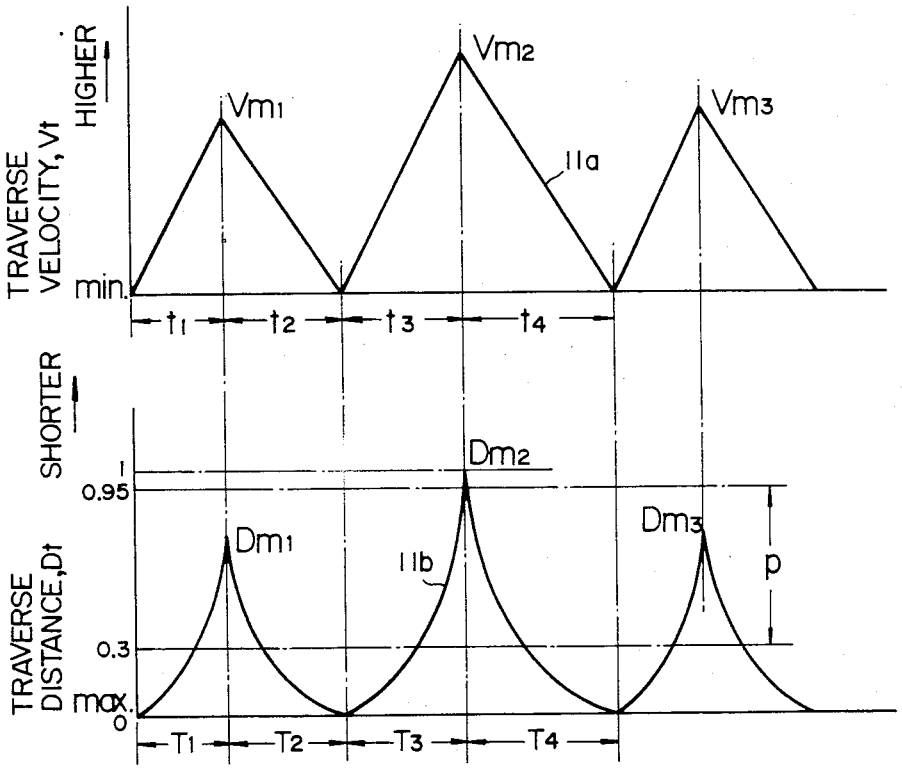
FIG. 11 is a view showing plots indicating the principles on which the traverse velocity and the traverse distance of the yarn to be wound on a bobbin are to be controlled in accordance with still another important aspect of the present invention.

The yarn package produced in the above described manner still has circumferential ribs as indicated at H in FIG. 10 although the ribs H are of a practically permissible degree. In accordance with another important aspect of the present invention, such circumferential ribs H are further reduced by controlling the traverse distance Dt of the yarn in such a manner as to have substantially fixed maximum limits and different minimum limits, as indicated by the plot 11*b* in FIG. 11 of the drawings. If, in this instance, the maximum limit of the traverse distance Dt is expressed as 0 in the form of a normalized value and the minimum value of the minimum limits (indicated at $D_{m1}$, $D_{m2}$ and $D_{m3}$ on the plot 11*b* in FIG. 11) of the traverse distance Dt is expressed as 1 also in the form of a normalized value, the traverse distance Dt of the yarn is controlled preferably further in such a manner that the maximum value of the minimum limits $D_{m1}$, $D_{m2}$, $D_{m3}$, . . . of the traverse distance Dt lies within the range of between 1 and any value selected within the range P of between about 0.3 and about 0.95. In the graphs of FIG. 11, the minimum value of the minimum limits $D_{m1}$, $D_{m2}$ and $D_{m3}$ of the traverse distance Dt is assumed to be given by the minimum limit $D_{m2}$. The normalized value 1 corresponding to the minimum value of the minimum limits $D_{m1}$, $D_{m2}$, $D_{m3}$, . . . of the traverse distance Dt is representative of the maximum amount of variation of the traverse distance Dt thus controlled. In the graphs of FIG. 11, such a maximum amount of variation of the traverse distance Dt is assumed to be given by the minimum limit $D_{m1}$. The minimum limits $D_{m2}$, $D_{m2}$, $D_{m3}$, . . . of the traverse distance Dt may be selected either at random or in such a manner as to vary in cycles. In whichsoever manner the minimum limits $D_{m1}$, $D_{m2}$, $D_{m3}$, . . . of the traverse distance Dt may be selected, it is important that the maximum limits (indicated at $V_{m1}$, $V_{m2}$, $V_{m3}$ on the plot 11*a* in FIG. 11) of the traverse velocity Vt be selected to vary similarly to and occur in synchronism with the minimum limits $D_{m1}$, $D_{m2}$, $D_{m3}$, . . . , respectively, of the traverse distance Dt. Furthermore, the ratio between the periods of time (indicated by $t_1$ and $t_2$ or $t_3$ or $t_4$ on the plot 11*a* in FIG. 11) for which the traverse velocity Vt is on the increase and decrease, respectively, during each cycle of variation of the traverse velocity Vt is equal to the ratio between the periods of time (indicated by $T_1$ and $T_2$ or $T_3$ and $T_4$ on the plot 11*b* in FIG. 11) for which the the traverse distance Dt is on the decrease and increase, respectively, during each cycle of variation of the traverse distance Dt, and the ratio between the amount of variation of the traverse velocity Vt and the amount of variation of the traverse distance Dt is maintained substantially constant during every cycle of variation of the traverse velocity Vt and distance Dt of the yarn. Thus, each of the traverse velocity Vt and distance Dt of the yarn is controlled to periodically vary in such a manner that the minimum limits $D_{m1}$, $D_{m2}$, $D_{m3}$, . . . of the traverse distance Dt and the maximum limits $V_{m1}$, $V_{m2}$, $V_{m3}$, . . . of the traverse velocity Vt vary either cyclically or at random within the range of between the maximum amount of variation and any value within the range of between about 30 percent and about 95 percent of the maximum amount of variation. In other words, the traverse velocity Vt of the yarn is controlled to periodically vary in such a manner that the minimum value (assumed to be given by the maximum limit $V_{m1}$ in FIG. 11) of the maximum limits $V_{m1}$, $V_{m2}$, $V_{m3}$, . . . of the traverse velocity Vt lies within the range of between the maximum value (assumed to be given by the maximum limit $V_{m2}$ in FIG. 11) of the maximum limits $V_{m1}$, $V_{m2}$, $V_{m3}$, . . . and any value within the range of between about 30 percent and about 95 percent of the difference between the minimum limit and the maximum value ($V_{m2}$) of the maximum limits $V_{m1}$, $V_{m2}$, $V_{m3}$, . . . of the traverse velocity Vt. On the other hand, the traverse distance Dt of the yarn is controlled to periodically vary in such a manner that the maximum value (assumed to be given by the minimum limit $D_{m1}$ in FIG. 11) of the minimum limits $D_{m1}$, $D_{m2}$, $D_{m3}$, . . . of the traverse distance Dt lies within the range of between the minimum value (assumed to be given by the minimum limit $D_{m2}$ in FIG. 11) of the minimum limits $D_{m1}$, $D_{m2}$, $D_{m3}$, . . . of the traverse distance Dt and any value within the range of between about 30 percent and about 95 percent of the difference between the maximum limit and the minimum value ($D_{m2}$) of the minimum limits $D_{m1}$, $D_{m2}$, $D_{m3}$, . . . of the traverse distance Dt.

Figure 14:
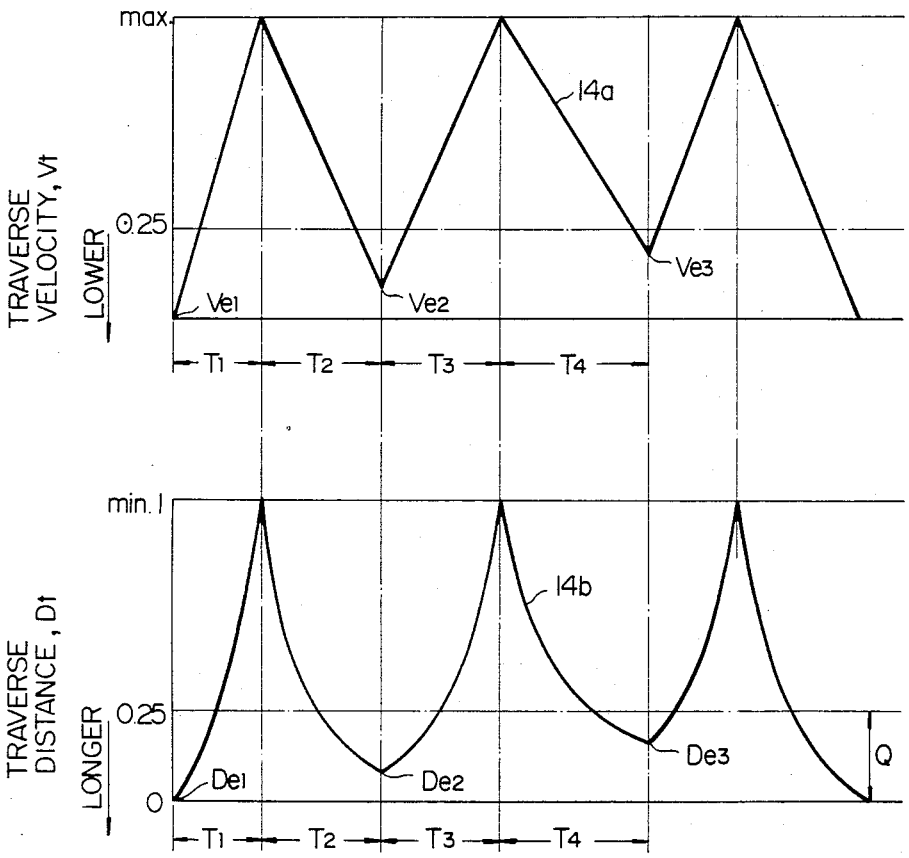
FIG. 14 is view showing plots indicating the principles on which the traverse velocity and the traverse distance of the yarn to be wound on a bobbin are to be controlled in accordance with still another important aspect of the present invention.

Formation of circular ribs on a wound-up yarn package can be avoided by controlling the traverse velocity Vt and distance Dt of the yarn in the manners hereinbefore described. It however happens that ribs are formed at the opposite axial ends of a yarn package during unwinding of the yarn therefrom due to, presumably, deformation of the yarn package as caused by the tension in the yarn wound into the package or by the radial forces with which the yarn package is pressed against the bobbin on which the yarn is wound. The circumferential ribs thus formed on a yarn package are practically negligible and for this reason will not be an impediment to the unwinding of the yarn therefrom at a high speed. When, however, it is desired that the yarn be unwound from such a yarn package at a speed higher than 1000 meter per minute, a circumferential rib formed on the yarn package may cause breakage of the yarn being unwound therefrom. In another important aspect of the present invention, such a problem can be solved by controlling the traverse distance Dt of the yarn in such a manner as to have substantially fixed minimum limits and different maximum as indicated by plot 14*b* in FIG. 14 of the drawings. In this instance, the minimum value of the maximum limits of the traverse distance Dt of the yarn is selected preferably within the range of between the maximum value of the maximum limits and any value within the range of between about 25 percent and about 0 percent of the maximum amount of variation in the traverse distance Dt, namely, the difference between the maximum value of the maximum limits and the minimum limit of the traverse distance Dt. Furthermore, the minimum limits of the traverse velocity Vt of the yarn are also preferably selected to vary similarly to and occur in synchronism with the maximum limits, respectively, of the traverse distance Dt as will be seen from plot 14*a* in FIG. 14 so that the traverse velocity Vt of the yarn varies within the range of between the minimum value of the minimum limits of the traverse velocity Vt and any value within the range of between about 25 percent and about 0 percent of the maximum amount of variation in the traverse velocity Vt, namely, the difference between the minimum value of the minimum limits and the maximum limit of the traverse velocity Vt. The maximum limits of the traverse distance Dt of the yarn as controlled in the above described manner are selected also in such a manner as to vary at random or in cycles.

Figure 12:
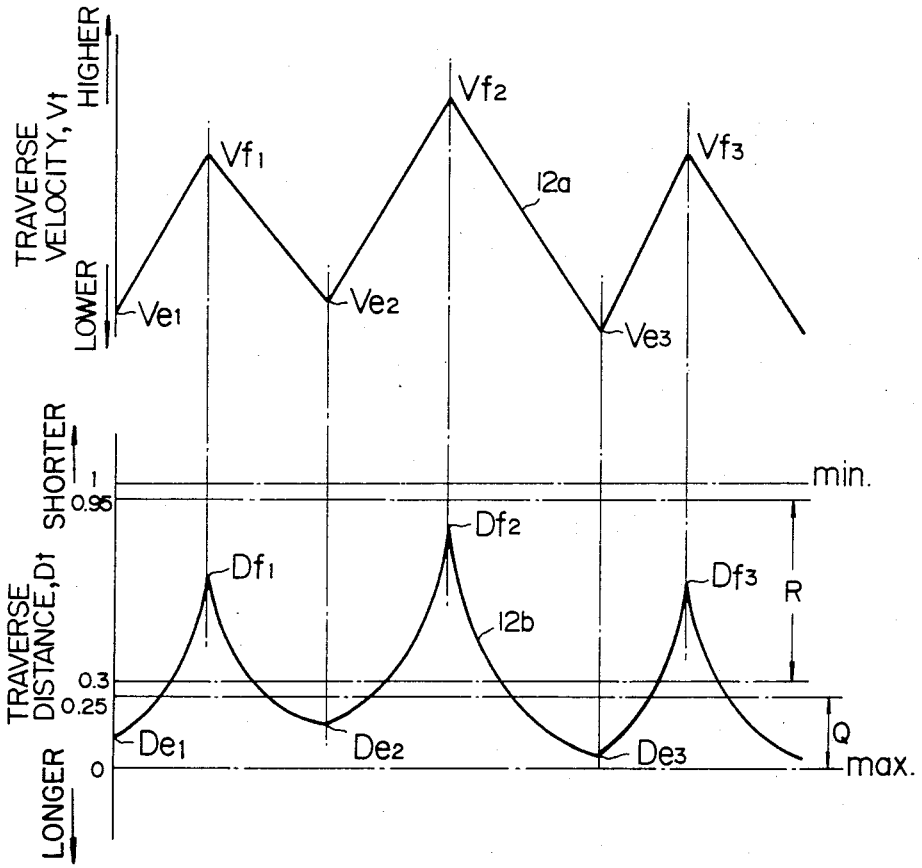
FIG. 12 is a view showing plots indicating the principles on which the traverse velocity and the traverse distance of the yarn to be wound on a bobbin are to be controlled in accordance with still another important aspect of the present invention.

Formation of circular ribs on a yarn package can be avoided also by controlling the traverse distance Dt of the yarn in such a manner that both the minimum limits and the maximum limits of the traverse distance Dt are varied as indicated in FIG. 12 of the drawings so as to completely preclude formation of circumferential ribs on a yarn package during unwinding of the yarn from the yarn package. If, in this instance, the maximum value of the maximum limits (indicated at $D_{e1}$, $D_{e2}$ and $D_{e3}$ on the plot 12*b* in FIG. 12) of the traverse distance Dt of the yarn is expressed as 0 in the form of a normalized value and the minimum value of the minimum limits (indicated at $D_{f1}$, $D_{f2}$ and $D_{f3}$ on the plot 12*b*) of the traverse distance Dt is expressed as 1 also in the form of a normalized value, the traverse distance Dt of the yarn is controlled in such a manner that the minimum value of the maximum limits $D_{e1}$, $D_{e2}$, $D_{e3}$, . . . of the traverse distance Dt lies within the range of between 0 and any value within the range Q of between about 0 and about 0.25 and the maximum value of the minimum limits $D_{f1}$, $D_{f2}$, $D_{f3}$, . . . of the traverse distance Dt lies within the range of between 1 and any value within the range R of between about 0.3 and about 0.95. The normalized value 1 corresponding to the minimum value of the minimum limits $D_{f1}$, $D_{f2}$, $D_{f3}$, . . . of the traverse distance Dt is representative of the maximum amount of variation of the traverse distance Dt thus controlled. The maximum limits $D_{e1}$, $D_{e2}$, $D_{e3}$, . . . and the minimum limits $D_{f1}$, $D_{f2}$, $D_{f3}$, . . . of the traverse distance Dt of the yarn may be selected either at random or in such a manner as to vary in cycles. In whichsoever manner the maximum limits $D_{e1}$, $D_{e2}$, $D_{e3}$, . . . and the minimum limits $D_{f1}$, $D_{f2}$, $D_{f3}$, . . . of the traverse distance Dt may be selected, it is important that the minimum limits (indicated at $V_{e1}$, $V_{e2}$, $V_{e3}$ on the plot 12*a* in FIG. 12) and the maximum limits (indicated at $V_{f1}$, $V_{f2}$, $V_{f3}$ on the plot 12*a*) of the traverse velocity Vt of the yarn be selected to vary similarly to and occur in synchronism with the maximum limits $D_{e1}$, $D_{e2}$, $D_{e3}$, . . . and the minimum limits $D_{f1}$, $D_{f2}$, $D_{f3}$, . . . , respectively, of the traverse distance Dt. Furthermore, the ratio between the periods of time for which the traverse velocity Vt is on the increase and decrease, respectively, during each cycle of variation of the traverse velocity Vt is equal to the ratio between the periods of time for which the the traverse distance Dt is on the decrease and increase, respectively, during each cycle of variation of the traverse distance Dt, and the ratio between the amount of variation of the traverse velocity Vt and the amount of variation of the traverse distance Dt is maintained substantially constant during every cycle of variation of the traverse velocity Vt and distance Dt of the yarn. Thus, the traverse velocity Vt of the yarn is also controlled to periodically vary in such a manner that the maximum value of the minimum limits $V_{e1}$, $V_{e2}$, $V_{e3}$, . . . of the traverse velocity Vt lies within the range of between the minimum value of the minimum limits $V_{e1}$, $V_{e2}$, $V_{e3}$, . . . of the traverse velocity Vt and any value within the range of between about 0 percent and about 25 percent of the maximum amount of variation in the traverse velocity Vt and that the minimum value of the maximum limits $V_{f1}$, $V_{f2}$, $V_{f3}$, . . . of the traverse velocity Vt lies within the range of between the maximum value of the maximum limits $V_{f1}$, $V_{f2}$, $V_{f3}$, . . . of the traverse velocity Vt and any value within the range of between about 30 percent and about 95 percent of the maximum amount of variation in the traverse velocity Vt.

If, in the meantime, formation of circumferential ribs on a yarn package is precluded excessively, it may follow that the yarn fails to properly form inner layers of the yarn package. Since, furthermore, outer layers of a yarn package have densities higher than those of inner layers and since the ribboning of the outer layers is usually more serious than the ribboning of the inner layers, the yarn unwound at a high speed from a yarn package which has been formed to be clear of circumferential ribs thereon tends to be broken in outer layers of the package more frequently than ordinarily formed yarn packages.

Figure 13:
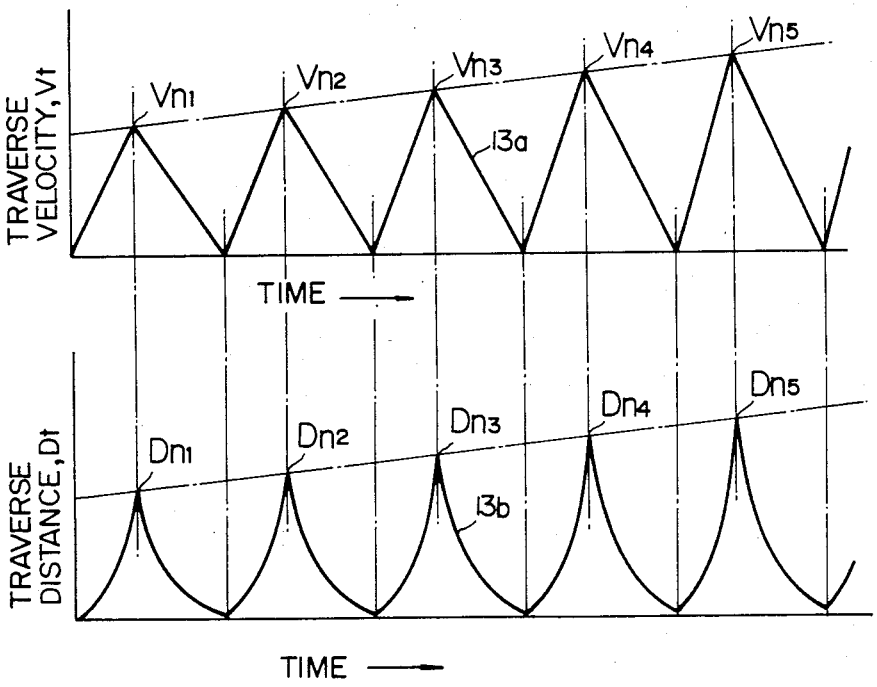
FIG. 13 is a view showing plots indicating the principles on which the traverse velocity and the traverse distance of the yarn to be wound on a bobbin are to be controlled in accordance with still another important aspect of the present invention.

With a view to solving these problems, it is herein further proposed to control the traverse velocity Vt and the traverse distance Dt of the yarn to periodically vary in such a manner that the amounts of variation of the traverse velocity Vt and traverse distance Dt increase from the start toward the end of yarn winding operation, as indicated by the plots 13*a* and 13*b*, respectively, in FIG. 13 of the drawings. In this instance, the amount of variation of the traverse velocity Vt may be increased by increasing the maximum limits (indicated by $V_{n1}$, $V_{n2}$, $V_{n3}$, $V_{n4}$ and $V_{n5}$ on the plot 13*a* in FIG. 13) of the traverse velocity Vt with the minimum limits of the traverse velocity Vt maintained substantially constant as shown in FIG. 13, by reducing the minimum limits of the traverse velocity Vt with the maximum limits of the traverse velocity Vt maintained substantially constant, or by increasing the maximum limits and reducing the minimum limits of the traverse velocity Vt. In this instance, the amount of variation of the traverse distance Dt is increased by reducing the minimum limits (indicated by $D_{n1}$, $D_{n2}$, $D_{n3}$, $D_{n4}$ and $D_{n5}$ on the plot 13*b* in FIG. 13) of the traverse distance Dt with the maximum limits of the traverse distance Dt maintained substantially constant as shown in FIG. 13. Furthermore, the period of each cycle of variation of the traverse velocity Vt and the period of each cycle of variation of the traverse distance Dt may be maintained substantially constant as shown in FIG. 13 or may be respectively increased in proportion to the increase in the amount of variation in the traverse velocity Vt and the increase in the amount of variation in the traverse distance Dt. In whichsoever manner the traverse velocity Vt and the traverse distance Dt of the yarn may be varied, it is important that the ratio between the amount of variation of the traverse velocity Vt and the amount of variation of the traverse distance Dt be maintained at all times substantially constant. The amount of variation of the traverse velocity Vt and the amount of variation of the traverse distance Dt may be increased linearly (with the increment varying in direct proportion to time) as shown in FIG. 13 or non-linearly, viz., exponentially or stepwise with time though not shown in the drawings.

When the traverse velocity Vt and traverse distance Dt of the yarn to be wound on a bobbin are controlled in these manners, circumferential ribs are formed slightly on the yarn package but the yarn is permitted to properly form layers of the yarn during an early stage of the winding operation when the yarn is to form inner layers of the yarn package. Furthermore, formation of circumferential ribs is precluded and the degree of seriousness of the ribboning is reduced during a final stage of the winding operation when the yarn is to form outer layers of the yarn package.

In winding a yarn into a biconical yarn package as shown in FIG. 2 of the drawings, the tension in the yarn being wound on a bobbin decreases and accordingly the density of the yarn package diminishes gradually as the diameter of the yarn package being produced increases. This is because of the fact that the tension in the yarn being wound decreases as the diameter of the yarn package increases. Such a problem could be solved if the traverse velocity Vt of the yarn or the velocity at which the yarn is to be wound is increased as the traverse distance Dt is reduced. This would however result in another problem that the resultant yarn package tends to bulge due to the excessive densities of outer layers of the package and creates difficulties in unwinding the yarn from such a yarn package.

In accordance with still another aspect of the present invention, the above noted problem is solved without creating such difficulties by increasing the traverse velocity Vt in such a manner that the traverse velocity Vt at a given point of time during a middle stage of yarn winding operation is higher than the traverse velocity Vt at the start of the yarn winding operation by about 5 percent to 60 percent of the ratio of the traverse distance Dt at the start of the winding operation to the traverse distance Dt at the aforesaid point of time during the middle stage of the winding operation. If, thus, the traverse velocities Vt of the yarn at the start and during the middle stage of the yarn winding operation are denoted as $V_o$ and $V_m$, respectively, and the traverse distances Dt of the yarn at the start and during the middle stage of the yarn winding operation are denoted as $D_o$ and $D_m$, respectively, the traverse velocity $V_m$ at the given point of time during the middle stage of the yarn winding operation is given as:

$$V_m = V_o \times [1 + D_o/D_m \times (0.05 \sim 0.60)]$$

In this instance, it is ideal that the traverse velocity Vt and traverse distance Dt of the yarn be controlled in such a manner that the traverse velocity Vt increases at a rate substantially equal to the rate of decrease of the traverse distance Dt. For practical purposes, however, substantially similar results can be obtained if the traverse velocity Vt and traverse distance Dt of the yarn are controlled so that the traverse velocity Vt increases linearly or non-linearly (viz., stepwise or exponentially) with time without respect to the rate of decrease of the traverse distance Dt.

While it has been assumed that the method proposed by the present invention is to be carried out by the use of the device illustrated in FIG. 3, it should be borne in mind that the method according to the present invention can be put into practice with use of the mechanism of another type of yarn winding or yarn take-up machine such as the mechanism of, for example the prior-art yarn take-up device. For this purpose, one may simply add, to the prior-art apparatus shown in FIG. 1, suitable control means programmed in such a manner as to provide the principles of control to achieve the steps of the method according to the present invention.

It may be further noted that each of the plots 9*b*, 11*b*, 12*b*, 13*b* and 14*b* in FIGS. 9, 11, 12, 13 and 14, respectively, may appear to have apeces or cusps at the maximum limits of the traverse distance, this however does not necessarily mean that the traverse distance is controlled in such a manner that the rate of variation of the traverse distance varies discretely across the maximum limits of the traverse distance. Thus, each of the plots 9*b*, 11*b*, 12*b*, 13*b* and 14*b* in FIGS. 9, 11, 12, 13 and 14, respectively, may be described by a series of curved sections which vary at rates varying continuously across the maximum limits of the traverse distance.

What is claimed is:

1. In a yarn take-up device having a plurality of successive traverse cycles in each of which a continuous yarn is to be helically wound on a rotating bobbin and traversed first in one direction and thereafter in the opposite direction substantially parallel with the axis of rotation of the bobbin, a method of winding the yarn on the bobbin, comprising producing first signals effective to control the traverse velocity of the yarn to vary between predetermined minimum and maximum limits within a predetermined range and second signals effective to control the traverse distance of the yarn to vary between predetermined maximum and minimum limits within a predetermined range, at least during a limited time interval, controlling the traverse velocity to periodically vary between the predetermined minimum and maximum limits thereof on the basis of said first signals and controlling the traverse distance to periodically vary between the predetermined maximum and minimum limits thereof on the basis of said second signals, the cycles of periodic variation of the traverse velocity being respectively identical and synchronized with the cycles of periodic variation of the traverse distance, each of the traverse velocity and the traverse distance being controlled to vary throughout all of the traverse cycles, each of the minimum limits of the traverse velocity and each of the maximum limits of the traverse distance occurring substantially at the beginning of each of the cycles of periodic variation of the traverse velocity and traverse distance and each of the maximum limits of the traverse velocity and each of the minimum limits of the traverse distance occurring substantially simultaneously during each of the cycles of periodic variation of the traverse velocity and traverse distance, wherein the traverse distance of the yarn is controlled to periodically vary at a rate which increases progressively as the traverse distance decreases from each of the maximum limits to each of the minimum limits thereof during each of the cycles of periodic variation of the traverse distance and which decreases progressively as the traverse distance increases from each of the minimum limits to each of the maximum limits thereof during each of the cycles of periodic variation of the traverse distance.

2. A method as set forth in claim 1, in which the traverse distance of the yarn is controlled to periodically vary in such a manner as to have its minimum limits fixed at a predetermined value throughout the cycles of variation of the traverse distance and its maximum limits varied irregularly for the individual cycles of variation of the traverse distance.

3. A method as set forth in claim 2, in which the traverse distance of the yarn is controlled so that the minimum value of the maximum limits thereof varies in each cycle of periodic variation thereof from the maximum value of the maximum limits to any value within the range of between about 75 percent and about 100 percent of the difference between the maximum value of the maximum limits and the minimum value of the minimum limits of the traverse distance.

4. A method as set forth in claim 3, in which the maximum limits of the traverse velocity of the yarn are selected to occur in synchronism with the minimum limits, respectively, of the traverse distance.

5. A method as set forth in claim 4, in which the ratio between the amount of variation of the traverse velocity and the amount of variation of the traverse distance is maintained substantially constant throughout each cycle of variation of the traverse velocity and traverse distance.

6. A method as set forth in claim 5, in which the traverse velocity of the yarn is controlled so that the maximum value of the minimum limits of the traverse velocity of the yarn varies in each cycle of periodic variation thereof from the minimum value of the minimum limits of the traverse velocity to any value within the range of between about 75 percent and about 100 percent of the difference between the minimum value of the minimum limits and the maximum value of the maximum limits of the traverse velocity.

7. A method as set forth in claim 6, in which the maximum limits of the traverse distance and the minimum limits of the traverse velocity are selected in such a manner as to vary irregularly for the individual cycles of variation of the traverse distance and traverse velocity.

8. A method as set forth in claim 6, in which the maximum limits of the traverse distance and the minimum limits of the traverse velocity are selected in such a manner as to vary in cycles.

9. A method as set forth in claim 1, in which the traverse distance of the yarn is controlled to periodically vary in such a manner that both the minimum limits and the maximum limits of the traverse distance are varied irregularly for the individual cycles of variation of the traverse distance.

10. A method as set forth in claim 9, in which the traverse distance of the yarn is controlled to periodically vary in such a manner that the minimum value of the maximum limits of the traverse distance varies in each cycle of periodic variation thereof from the maximum value of the maximum limits of the traverse distance to any value within the range of between about 0 percent and about 25 percent of the difference between the maximum value of the maximum limits and the minimum value of the minimum limits of the traverse distance and that the maximum value of the minimum limits of the traverse distance varies in each cycle of periodic variation thereof from the minimum value of the minimum limits of the traverse distance to any value within the range of between about 30 percent and about 95 percent of the difference between the maximum value of the maximum limits and the minimum value of the minimum limits of the traverse distance.

11. A method as set forth in claim 10, in which the minimum limits and the maximum limits of the traverse velocity of the yarn are selected to occur in synchronism with the maximum limits and the minimum limits, respectively, of the traverse distance.

12. A method as set forth in claim 11, in which the ratio between the amount of variation of the traverse velocity and the amount of variation of the traverse distance is maintained substantially constant throughout each cycle of variation of the traverse velocity and traverse distance.

13. A method as set forth in claim 12, in which the traverse velocity of the yarn is controlled to periodically vary in such a manner that the maximum value of the minimum limits of the traverse velocity varies in each periodic variation thereof from the minimum value of the minimum limits of the traverse velocity to any value within the range of between about 0 percent and about 25 percent of the difference between the maximum value of the maximum limits and the minimum value of the minimum limits and that the minimum value of the maximum limits of the traverse velocity varies in each periodic variation thereof from the maximum value of the maximum limits of the traverse velocity to any value within the range of between about 30 percent and about 95 percent of the difference between the maximum value of the maximum and the minimum value of the minimum limits of the traverse velocity.

14. A method as set forth in claim 13, in which the maximum and minimum limits of the traverse distance and the minimum and maximum limits of the traverse velocity are selected in such a manner as to vary irregularly for the individual cycles of variation of the traverse distance and traverse velocity.

15. A method as set forth in claim 13, in which the maximum and minimum limits of the traverse distance and the minimum and maximum limits of the traverse velocity are selected in such a manner as to vary in cycles.

16. A method as set forth in claim 1, in which the traverse velocity and the traverse distance of the yarn are controlled to periodically vary in such a manner that the the difference between the minimum and maximum limits of each of the traverse velocity and traverse distance increases as the cycles of variation of the traverse velocity and traverse distance proceed.

17. A method as set forth in claim 16, in which the maximum limits of the traverse velocity are increased as the cycles of periodic variation of the traverse velocity proceed with the minimum limits of the traverse velocity maintained substantially constant and the minimum limits of the traverse distance are reduced as the cycles of periodic variation of the traverse distance proceed with the maximum limits of the traverse distance maintained substantially constant.

18. A method as set forth in claim 16, in which the minimum limits of the traverse velocity are reduced as the cycles of periodic variation of the traverse velocity proceed with the maximum limits of the traverse velocity maintained constant and the minimum limits of the traverse distance are reduced as the cycles of periodic variation of the traverse distance proceed with the maximum limits of the traverse distance maintained substantially constant.

19. A method as set forth in claim 16, in which the maximum limits and the minimum limits of the traverse velocity are increased and reduced, respectively, as the cycles of periodic variation of the traverse velocity proceed and the minimum limits of the traverse distance reduced as the cycles of periodic variation of the traverse distance proceed.

20. A method as set forth in claim 16, in which the period of each cycle of variation of the traverse velocity and the period of each cycle of variation of the traverse distance are maintained substantially constant.

21. A method as set forth in claim 16, in which the period of each cycle of variation of the traverse velocity and the period of each cycle of variation of the traverse distance are respectively increased in proportion to the increase in the amount of variation in the traverse velocity and the increase in the amount of variation in the traverse distance.

22. A method as set forth in claim 16, in which the ratio between the amount of variation of the traverse velocity and the amount of variation of the traverse distance is maintained substantially constant throughout each cycle of variation of the traverse velocity and the traverse distance.

23. A method as set forth in claim 16, in which the difference between the minimum and maximum limits of each of the traverse velocity and the traverse distance is increased at a rate which varies substantially linearly as the cycles of periodic variation of each of the traverse velocity and the traverse distance proceed.

24. A method as set forth in claim 16, in which the difference between the minimum and maximum limits of each of the traverse velocity and the traverse distance is increased non-linearly as the cycles of periodic variation of each of the traverse velocity and the traverse distance proceed.

25. A method as set forth in claim 16, in which the difference between the minimum and maximum limits of each of the traverse velocity and the traverse distance is stepwise increased as the cycles of periodic variation of each of the traverse velocity and the traverse distance proceed.

26. In a yarn take-up device having a plurality of successive traverse cycles in each of which a continuous yarn is to be helically wound on a rotating bobbin and traversed first in one direction and thereafter in the opposite direction substantially parallel with the axis of rotation of the bobbin, a method of winding the yarn on the bobbin, comprising producing first signals effective to control the traverse velocity of the yarn to vary between predetermined minimum and maximum limits within a predetermined range and second signals effective to control the traverse distance of the yarn to vary between predetermined maximum and minimum limits within a predetermined range, at least during a limited time interval, controlling the traverse velocity to periodically vary between the predetermined minimum and maximum limits thereof on the basis of said first signals and controlling the traverse distance to periodically vary between the predetermined maximum and minimum limits thereof on the basis of said second signals, the cycles of periodic variation of the traverse velocity being respectively identical and synchronized with the cycles of periodic variation of the traverse distance, the traverse velocity being controlled to vary throughout all of the traverse cycles, each of the maximum limits of the traverse velocity and each of the minimum limits of the traverse distance occurring substantially simultaneously during each of the cycles of periodic variation of the traverse velocity and traverse distance, the traverse distance of the yarn being controlled to periodically vary at a rate which increases progressively as the traverse distance decreases from each of the maximum limits to each of the minimum limits thereof during each of the cycles of periodic variation of the traverse distance.

27. A method as set forth in claim 26, in which the traverse distance of the yarn is further controlled to periodically vary at a rate which decreases progressively as the traverse distance increases from each of the minimum limits to each of the maximum limits thereof during each of the cycles of periodic variation of the traverse distance.

28. A method as set forth in claim 26 or 27, in which the traverse distance of the yarn is controlled to periodically vary in such a manner as to have its maximum and minimum limits fixed throughout the cycles of variation of the traverse distance.

29. A method as set forth in claim 26 or 27, in which the traverse distance of the yarn is controlled to periodically vary in such a manner as to have its maximum limits fixed at a predetermined value throughout the cycles of variation of the traverse distance and its minimum limits varied irregularly for the individual cycles of variation of the traverse distance.

30. A method as set forth in claim 29, in which the maximum value of the minimum limits of the traverse distance of the yarn is selected within the range of between the minimum value of the minimum limits of the traverse distance and any value within the range of between about 30 percent and about 95 percent of the difference between the maximum limit and the minimum value of the minimum limits of the traverse distance.

31. A method as set forth in claim 30, in which the maximum limits of the traverse velocity of the yarn are selected to occur in synchronism with the minimum limits, respectively, of the traverse distance.

32. A method as set forth in claim 31, in which the ratio between the amount of variation of the traverse velocity and the amount of variation of the traverse distance is maintained substantially constant throughout each cycle of variation of the traverse velocity and traverse distance.

33. A method as set forth in claim 32, in which the maximum limits of the traverse velocity of the yarn are selected in such a manner that the minimum value of the maximum limits of the traverse velocity of the yarn lies within the range of between the maximum value of the maximum limits of the traverse velocity and any value within the range of between about 30 percent and about 95 percent of the difference between the minimum limit and the maximum value of the maximum limits of the traverse velocity.

34. A method as set forth in claim 33, in which the minimum limits of the traverse distance and the maximum limits of the traverse velocity are selected in such a manner as to vary irregularly for the individual cycles of variation of the traverse velocity and traverse distance.

35. A method as set forth in claim 33, in which the minimum limits of the traverse distance and the maximum limits of the traverse velocity are selected in such a manner as to vary in cycles.

* * * * *